United States Patent [19]

Harper et al.

[11] 3,997,746

[45] Dec. 14, 1976

[54] CIRCUIT BREAKER WITH ARC CHAMBER SCREEN

[75] Inventors: George S. Harper; Lyal N. Merriken, both of Cambridge, Md.

[73] Assignee: Airpax Electronics, Incorporated, Cambridge, Md.

[22] Filed: Mar. 28, 1975

[21] Appl. No.: 562,919

Related U.S. Application Data

[63] Continuation-in-part of Ser. No. 463,269, April 23, 1974, abandoned.

[52] U.S. Cl. ..... 200/144 R; 200/148 C; 335/201

[51] Int. Cl.[2] ..... H01H 9/30; H01H 33/00

[58] Field of Search ..... 200/144 R, 148 C; 335/201

[56] References Cited

UNITED STATES PATENTS

| | | | |
|---|---|---|---|
| 2,988,622 | 6/1961 | Petermichl et al. | 200/148 C |
| 3,582,966 | 6/1971 | Strobel | 200/144 R |
| 3,780,249 | 12/1963 | Harper | 200/144 R |

*Primary Examiner*—George Harris
*Attorney, Agent, or Firm*—LeBlanc & Shur

[57] ABSTRACT

Disclosed is a molded case type magnetic circuit breaker having improved performance and an increased current rating. A corrosion and temperature resistant stainless steel wire screen having specific wire and mesh opening sizes overlies a novel exhaust gas baffle arrangement to cool and disperse arc chamber gases venting from the breaker. Flashover during high current switching, due to conduction through the exhaust gas plasma, is eliminated. Also disclosed is a novel arc chamber construction for the circuit breaker and a marine baffle for adapting the breaker to use in potentially explosive atmospheres.

25 Claims, 12 Drawing Figures

CIRCUIT BREAKER WITH ARC CHAMBER SCREEN

This application is directed to modifications of the circuit breaker construction of U.S. Pat. Nos. 3,780,249 and 3,786,380 and is a continuation-in-part of copending application Ser. No. 463,269 filed Apr. 23, 1974, now abandoned.

This invention relates to molded case electrical circuit breakers and more particularly to circuit breakers of this type incorporating an arc plasma screen which improves performance and increases the current rating of the circuit breaker.

In U.S. Pat. Nos. 3,780,249 and 3,786,380, there are disclosed electrical circuit breakers in which the arc chamber is closed off by a relatively fine wire mesh or a screen. The screen is provided in the devices of those applications to arrest flames from the arc chamber so that the devices can be used in an explosive atmosphere such as a marine bilge without fear of igniting gasoline vapors in the bilge. While fine wire mesh screens are suited for use as flame arresters in the breakers handling relatively small currents, they are not applicable to circuit breakers with higher ampere ratings because they impede the escape of gas from the arc chamber and are subject to rapid burnout when switching at higher current levels.

As is well known, the arcing which accompanies the opening and closing of circuit breaker contacts, especially under overload conditions, generates gases in the circuit breaker arc chamber which are frequently vented to atmosphere in order to permit excessive build-up of heat and pressure within the circuit breaker case or housing. In circuit breakers with current and voltage ratings of as much as 100 amperes and 600 volts or more, the heat and pressure build-up can be substantial so that venting of the arc chamber to atmosphere is essential for proper operation of the breaker. However, it has been found that the venting gases are in the nature of an electrically conductive plasma and under certain circumstances can present a conductive leakage path to ground which interferes with proper operation of the breaker and makes it unacceptable for many applications.

In order to overcome this problem, the present invention is directed to an enclosed or molded case magnetic circuit breaker of relatively high current and voltage rating in which the arc gases are vented from the arc chamber to atmosphere through a wire mesh or screen of a selected size and material such that the conductive plasma is cooled and broken up or dispersed so as to prevent short circuiting between the line terminal of the circuit breaker and the external panel.

Although it has been previously proposed to vent arc gases through a wire screen, the previous proposed devices are believed to have been unsatisfactory at high current levels for a number of reasons. If the screen mesh is too fine, excessive blockage of the vent causes reduced short circuit performance. Also, too fine a wire size results in rapid screen burnout and complete loss of the dispersing function. Too large an increase in the mesh openings or the mesh wire size results in insufficient dispersion and cooling of the plasma with the resulting short circuit path to ground through the conductive plasma exiting from the circuit breaker housing. Furthermore, insofar as applicants are aware, the previous proposals have involved wire screens made of plated steel which are subject to corrosion and burnout and cannot withstand the severe atmosphere of the exiting arc gases over the normal operating life of the circuit breaker.

In the present invention, the arc screen is formed from a temperature-resistant stainless steel having a carefully selected mesh opening and wire size so that the arc plasma is cooled and dispersed without at the same time creating an excessive build-up of heat and pressure within the circuit breaker housing. The high temperature characteristic of the stainless steel permits smaller wire size without burnout and, therefore, more effective plasma cooling. The non-corrosive nature of the screen material means that plating is not required and the plating does not burn off during normal operation as with previous constructions, thus permitting corrosive destruction in less than the normal operating life of the circuit breaker. The screen is combined in the present invention with a novel circuit breaker baffle arrangement so as to substantially increase the current rating and operating life of the breaker. Also disclosed is a modified embodiment for use in potentially explosive atmospheres in which the wire screen is replaced by an arc plasma shield.

It is, therefore, one object of the present invention to provide an electrical circuit breaker having an increased current rating for its size.

Another object of the present invention is to provide a circuit breaker in an enclosure or housing in which arc gases are vented from the enclosure or housing through an improved wire screen and gas chute baffle arrangement.

Another object of the present invention is to provide a wire screen for the vent chamber of molded case circuit breakers formed from a temperature-resistant stainless steel alloy.

Another object of the present invention is to provide an enclosed circuit breaker having an arc gas vent screen with the mesh openings and wire size selected to adequately disperse and cool the exiting gases without at the same time excessively restricting gas flow and impairing the high current performance of the breaker.

Another object of the present invention is to provide a circuit breaker with a novel arc chute assembly.

Another object of the present invention is to provide an improved arc chamber for a molded case circuit breaker.

Another object of this invention is to provide a molded case circuit breaker usable in potentially explosive atmospheres.

These and further objects and advantages of the invention will be more apparent upon reference to the following specification, claims and appended drawings, wherein:

Figure 1:
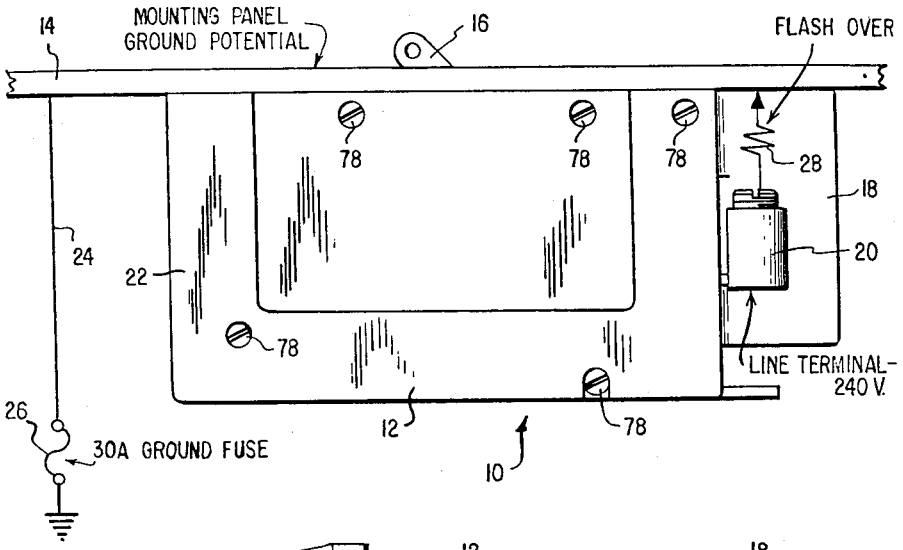
FIG. 1 is a front elevation of a panel circuit breaker in accordance with the present invention.

Referring to the drawings, the novel circuit breaker of the present invention is generally indicated at 10 in FIG. 1. It comprises a molded case 12 which is suitably secured by an arrangement (not shown) to a mounting panel 14, customarily at ground potential. The circuit breaker is manually operated by a handle 16, projecting through a suitable aperture in mounting panel 14. The circuit breaker case includes an outwardly projecting flange 18, and adjacent this flange is one terminal 20 of the circuit breaker. Terminal 20 is illustrated as a conventional 240 volt circuit breaker line terminal, but it is understood that a conventional 120 volt or 480 volt line terminal may be employed as desired. The other circuit breaker terminal does not appear in FIG. 1, since it is located in a recess in the other end 22 of the circuit breaker housing.

By way of example only, the circuit breaker 10 of FIG. 1 may be of the type identified as Airpax Model 209. This circuit breaker has a rating of 100 amperes at 240 volts and FIG. 1 illustrates the test assembly for obtaining this rating in accordance with Underwriters' Laboratories, Inc. Standard UL 489 for molded case circuit breakers and circuit breaker enclosures. In accordance with this test procedure, the electrically conductive mounting panel 14 is connected to ground by a lead 24 through a 30 ampere ground fuse 26 in order to detect any flashover or excessive current leakage from terminal 20 to mounting panel 14, as indicated in FIG. 1 by the path through resistor 28. Resistor 28 represents the resistance of the arc plasma gases exiting from the circuit breaker housing in the area of terminal 20 and excessive current leakage through the plasma from terminal 20 to mounting panel 14 is detected by blowing the 30 amp ground fuse 26.

Figure 2:
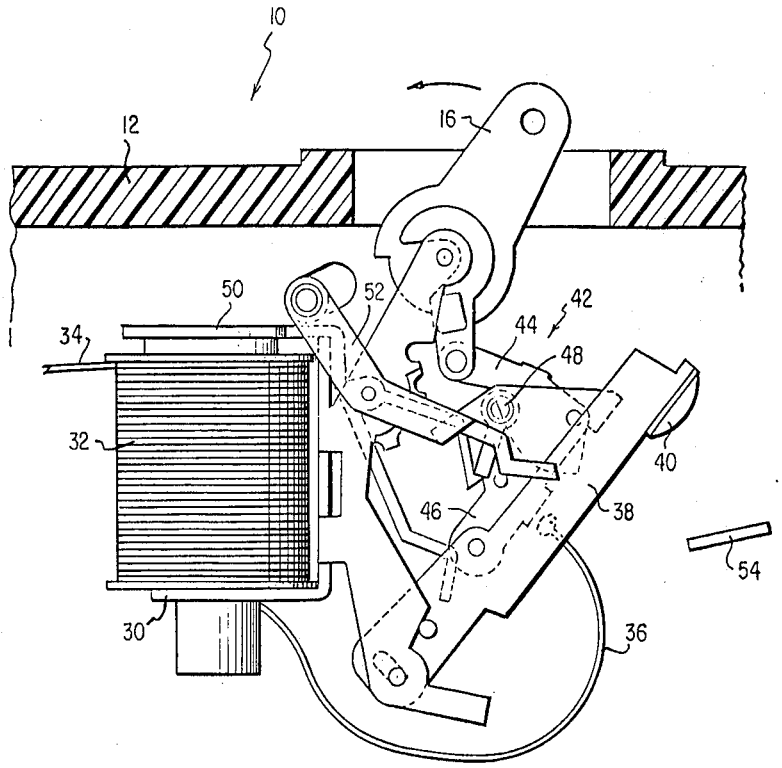
FIG. 2 is a partial cross-section showing the interior operating mechanism of the circuit breaker of FIG. 1.
Figure 5:
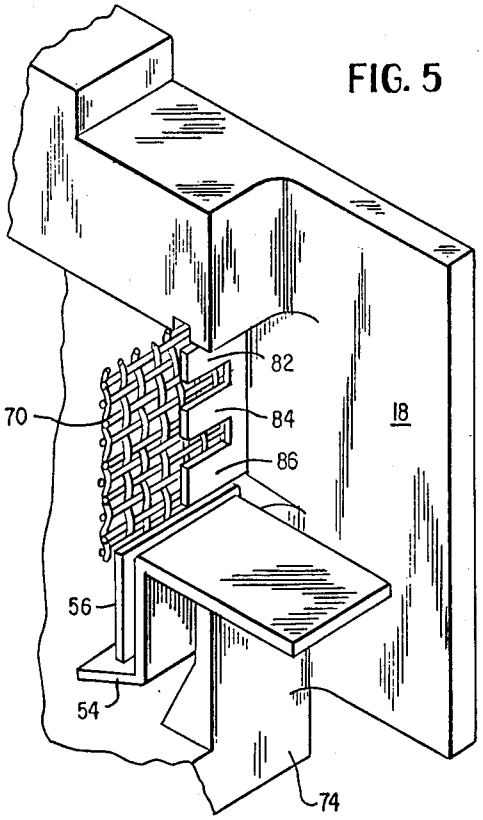
FIG. 5 is a perspective view of a portion of the breaker of FIG. 4 showing the relationship between the baffles and the wire mesh or screen.

FIG. 2 shows the operating mechanism for the circuit breaker 10. The mechanism is of the type more fully shown and described in U.S. Pat. No. 3,786,380 the disclosure of which is incorporated herein by reference. Briefly, housing 12 supports a frame 30 on which is mounted an electromagnetic coil 32 connected to one terminal of the breaker by a lead 34 with the other end of the coil electrically connected by a flexible lead 36 to a contact bar 38 carrying a movable circuit breaker contact 40. Contact bar 38 is connected to handle 16 by a collapsible toggle mechanism generally indicated at 42 and comprising toggle links 44 and 46. The links collapse when a sear 48 is tripped by one end of an armature 50 whose other end is attracted to a pole of the electrical solenoid formed by coil 32 when an overcurrent flows through the coil windings. Also shown in FIG. 2 is a cross-trip lever 52 which can be operated to trip adjacent poles when the toggle links 44 and 46 collapse due to overcurrent through the coil.

In FIG. 2, the toggle mechanism is shown in the collapsed or tripped condition so that the movable contact 40 has moved in a counter-clockwise direction away from stationary contact 54. This latter contact extends through the housing 12 and may have attached to it the 240 volt terminal 20 of FIG. 1 or, alternatively, may form a conventional 120 or 480 volt terminal, depending upon whether the breaker is used in a 240 volt circuit, a 120 volt or a 480 volt circuit.

As previously indicated, a fine screen and simplified baffle arrangement has been found quite satisfactory for providing flame arrest at low currents. However, it has not been found satisfactory for dispersing plasma at higher currents such as up to 100 amperes and more. In order to increase the current rating of the breaker and prevent flashover to the mounting panel at higher current levels, the present invention provides the modified screen and baffle assembly illustrated in FIGS. 3 through 6.

In order to obtain a current rating of 100 amperes pursuant to Underwriter's Laboratories Classification UL 489, the circuit breaker in the assembly of FIG. 1 is subjected to the following test sequence.

1. Overload — 50 operations — 600 amperes at 240 volts, 60 Hz, 0.45 power factor.
2. Tested for excessive terminal temperature rise at 100 amperes.
3. Endurance — 6,000 operations at 100 amperes, 240 volts, 60 Hz, 0.45 power factor, followed by 4,000 operations at no load.
4. Short circuit — three operations in a circuit calibrated for 5,000 amperes (10,000 optional), at 240 volts, 60 Hz, 0.45 power factor.
5. Time delay calibration.
6. Di-electric — withstand 1,500 volts at 60 Hz.

As can be seen, the above rather severe tests make it necessary to release the hot gas and plasma generated during the operation simulated by the test steps 1 and 4 above. It has been found during extensive testing that without the improved screen and baffle arrangement of this invention, there is a tendency for occasional flashover from terminal 20 to the mounting panel 14, as indicated by the resistance path 28, and this constitutes a safety hazard and, therefore, test failure.

Figure 3:
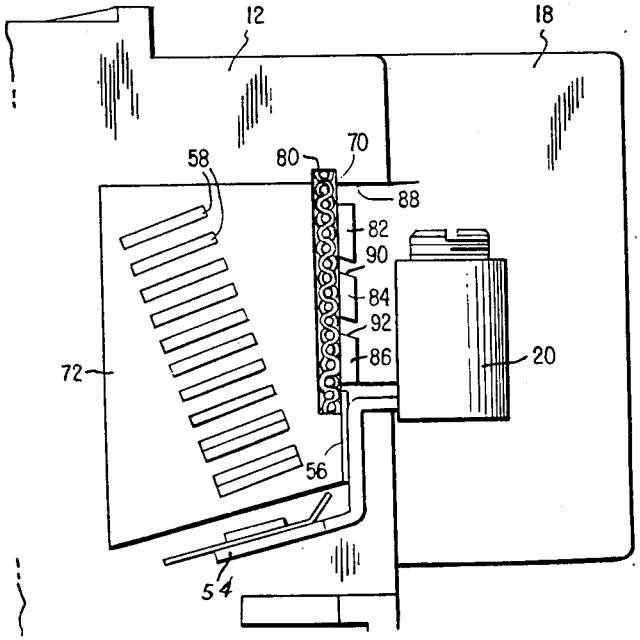
FIG. 3 is a cross-section of the circuit breaker of FIG. 1 showing the novel screen mounting and arc chamber arrangement of this invention.

Referring to FIG. 3, the modified screen of the present invention is illustrated at 70 in that Figure, and is located adjacent the stationary contact assembly 54 and the arc suppressor plates 58, which suppressor plates are mounted on an electrical insulator baffle plate 72. The aperture through which stationary terminal 54 passes is closed off by an electrically insulating baffle 56 and adjacent the path of movable contact 40 are a plurality of arc suppressor plates 58. Arc gases pass through the housing to atmosphere by way of a screen 70 and upper horizontal vent channel 62 and a pair of downwardly extending vent chutes 90 and 92.

Figure 4:
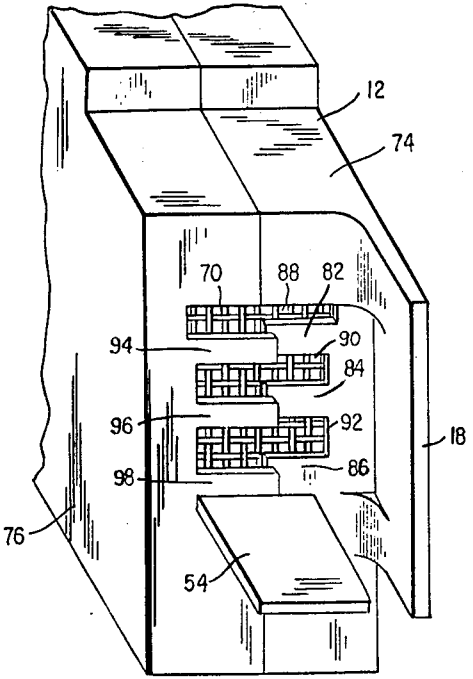
FIG. 4 is a perspective view of the end of the circuit breaker showing the construction of the gas exit baffles.

As best seen in FIG. 4, the case 12 is formed by two mating half-sections 74 and 76, joined by pins as illustrated, for example, at 78 in FIG. 1. Each section is provided with a rectangular recess such as the recess 80 in FIG. 3, which receives and retains the edges of the woven mesh screen 70. If desired, the screen may be retained in the recesses by applying suitable adhesive to its edges, but this has not been found necessary. The screen abuts on one side against the edges of the suppressor plate support 72 and on its other side against three projections or fingers 82, 84 and 86 (FIG. 3), extending outwardly from flange 18, normal to the flange. These fingers are spaced to provide the upper horizontal exit chute 88 and two downwardly slanting exit chutes 90 and 92. In vertical alignment with projections 82, 84 and 86, but displaced outwardly further away from the screen 70, are similar fingers or projections 94, 96 and 98, forming a part of the other case half 76. Exhaust gases are thus able to exhaust through the screen 70 by way of three exhaust chutes 88, 90 and 92.

In the preferred embodiment, the screen 70 is a woven wire mesh of 0.032 stainless steel wire on 1/16th of an inch centers located between the circuit breaker contacts and the arc baffles or projections as shown. Other wire mesh sizes may be used, such as 0.032 wire on 1/14th inch centers, 0.032 wire on 1/18th inch centers, or 0.028 wire on 1/18th inch centers. Practical sizes are believed limited to the range given, since as previously indicated if the mesh is too fine, burnout and exhaust gas obstruction results, whereas if the mesh is too open, insufficient cooling and dispersion of the exhaust gas is obtained.

The material from which the wire mesh is formed is also quite critical. While other temperature and corrosion-resistant materials may be used, it has been found that stainless stell alloys (unplated) are particularly suited for forming the screen. These stainless steels are iron-based alloys containing more chromium than the 12% necessary to provide passivity, but less than 30%. Suitable alloys of stainless steel are available in wire form and adaptable to screen fabrication and include stainless steel alloy types 302, 304, 305, 410 and 430. The composition by weight and properties of these alloys are summarized as follows:

| Type | Nickel % | Chromium % | High Temperature Performance | Corrosion Resistance |
|---|---|---|---|---|
| 302 | 8 to 10 | 17 to 19 | Good | Excellent |
| 304 | 8 to 12 | 18 to 20 | Good | Excellent |
| 305 | 10 to 13 | 17 to 19 | Good | Excellent |
| 410 | — | 11.5 to 13.5 | Good | Fair |
| 430 | — | 14 to 18 | Good | Fair |

Of the above, the preferred material for the arc vent screen is the austenitic alloy type 302, since it has one of the best combinations of desirable characteristics and is low in cost.

In addition to the provision of the plasma dispersing screen an important feature of the present invention resides in a novel arc chamber assembly which cooperates with the screen in exhausting arc gases from the circuit breaker housing. It is believed that the high temperatures of the arc gases in a molded case circuit breaker carrying relatively high currents and voltages in some instances tend to cause the plastic material of the case to break down. In any event carbon deposits have been in some instances noted on the screen which are believed to result from a decomposition of the plastic case structure located at and near the arc chamber.

Figure 6:
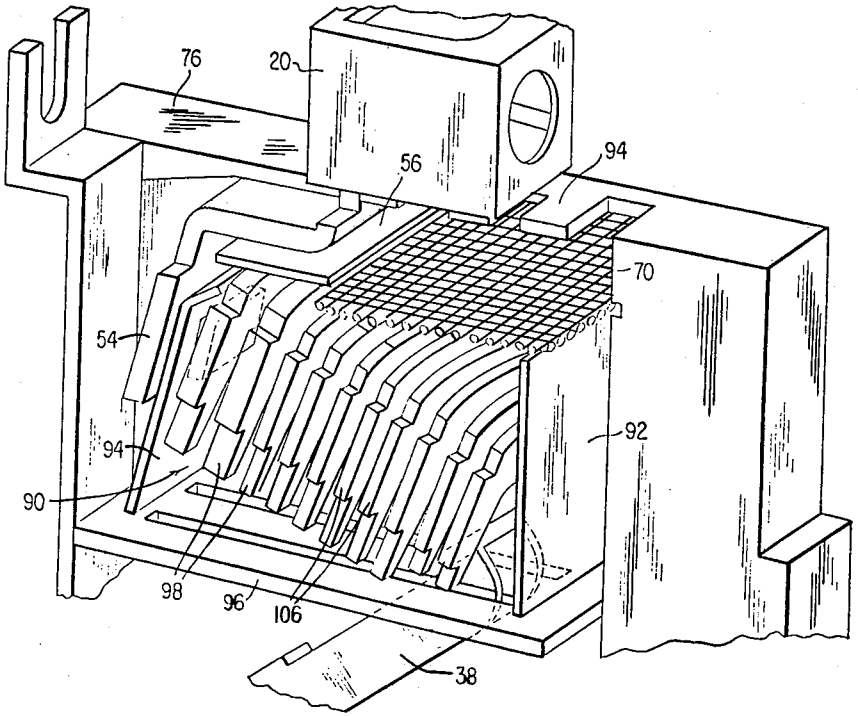
FIG. 6 is a cross-section in perspective showing the arc chamber and arc chute of FIG. 3 in more detail.

In order to avoid breakdown of the case material and the resulting deposits on the screen which might ultimately lead to screen clogging the present invention provides a novel arc chamber generally indicated at 90 in FIG. 6. In that FIG. like parts bear like reference numerals. The arc chamber is constructed as a substantially completely enclosed box bounded on opposite sides by a pair of baffle plates one of which is illustrated at 72 in FIG. 3. The ends of the arc chamber in FIG. 6 are bounded respectively by a top shield 92 and an arc plate 94, the latter being mounted on the interior portion of the terminal 54. The other two sides of the arc chamber are closed off respectively by first the slotted arc shield 96 through which the bifurcated contact 38 passes and secondly by the combination of the terminal insulator or baffle 56 and the wire mesh screen 70. A further feature of the arc chamber as illustrated in FIG. 6 is the provision in the chamber of a large number of relatively heavy metal arc suppressors 98 which in combination with the relatively heavy metal contact 54 and associated metallic structure provides good heat absorption within the arc chamber and helps to reduce the temperature at the surfaces of the plastic case.

Figure 7:
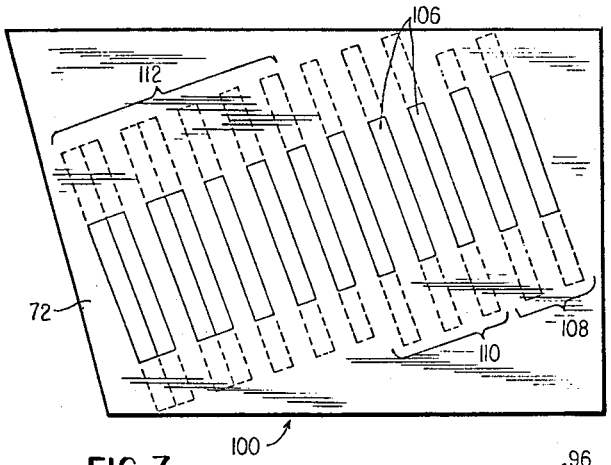
FIG. 7 is a side view of the arc chute baffle assembly of FIG. 6.
Figure 8:
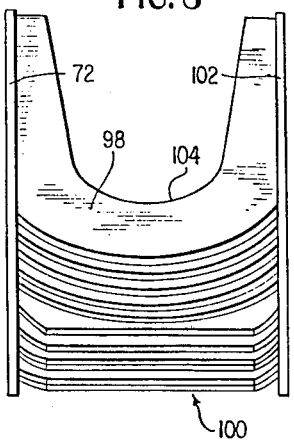
FIG. 8 is an end view of the assembly of FIG. 7.

FIG. 7 is a side elevation of the baffle assembly generally indicated at 100 and FIG. 8 is an end view of it. It comprises a pair of spaced baffle plates or supports including the plate 72 of FIG. 3 and an opposite identical baffle plate 102. These two baffle plates as well as the plates 56, 92 and 96 of FIG. 6 are preferably formed of suitable heat and electrical insulating material such as a vulcanized fiber commonly referred to as "fishpaper". The arc suppressors 98 as best seen in FIG. 8 are generally U-shaped construction to provide an open center 104 for passage of the movable contact and extreme end of the contact bar 38. The arc suppressors are preferably of relatively heavy steel and are provided on each edge with outwardly extending rectangular shoulders 106 which pass through corresponding apertures in the two plates 72 and 102 so that baffle plates 72 and 102 act to support suppressors 98 in a spaced, stacked relation as illustrated. The arc suppressors 106 are arranged in three groups namely a first group 108 of two suppressors slightly shorter than the others, a second group 110 of slightly longer suppressors and a third group 112 of five suppressors of intermediate length. There are three suppressors in the longer group 106 and in addition the lowermost two suppressors of group 112 are of double thickness to provide a greater amount of steel adjacent the juncture of the stationary and movable contacts.

Figure 9:
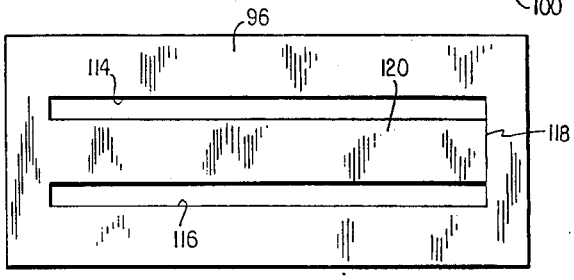
FIG. 9 is a plan view of the arc chute baffle plate through which a portion of the contact bar passes.

FIG. 9 is a plan view of the arcing shield or baffle 96 which is of flat, rectangular configuration and which is provided with a pair of parallel slots 114 and 116 for passing the two halves of the bifurcated contact bar 38 of FIG. 6. As previously indicated, shield 96 is preferably made of fishpaper (vulcanized fiber) and is sheared completely through along a line 118 adjoining the two adjacent ends of the slots 114 and 116 so as to provide a central flexible tab 120.

Figure 10:
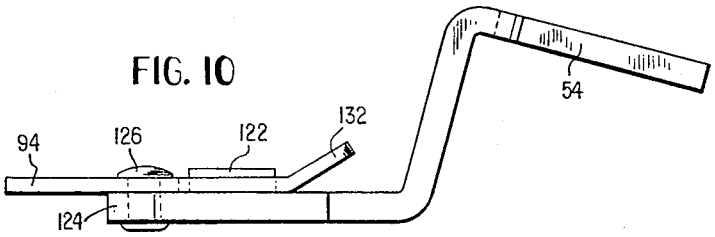
FIG. 10 is an enlarged elevation of the stationary contact and terminal assembly.
Figure 11:
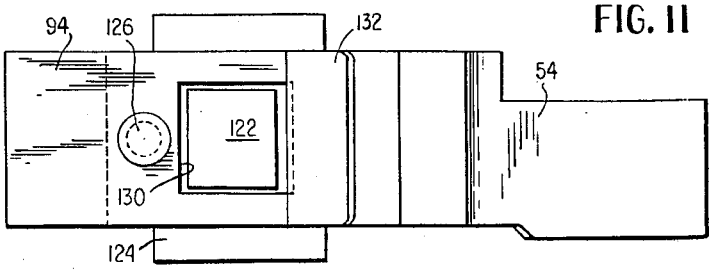
FIG. 11 is a plan view of the assembly of FIG. 10.

FIG. 10 is an elevational view and FIG. 11 is a plan view of the electrically conductive metal terminal 54 which carries the stationary contact of the circuit breaker. The stationary contact itself is illustrated at 122 as of rectangular configuration and formed as an integral projection of the terminal 54. Passing through the terminal 54 adjacent its interior end 124 is a rivet 126 which is used to secure to the terminal an electrically conductive metal arc plate 94. This plate is apertured as at 130 in FIG. 11 to permit upward projection of stationary contact 122 and has an upwardly turned end 132. Plate 94 acts as a shoe for stationary contact 122 to add metal adjacent the area of arcing between the contacts and to deflect arc gases so as to prevent blow-out through the bottom seam between the two case halves.

Figure 12:
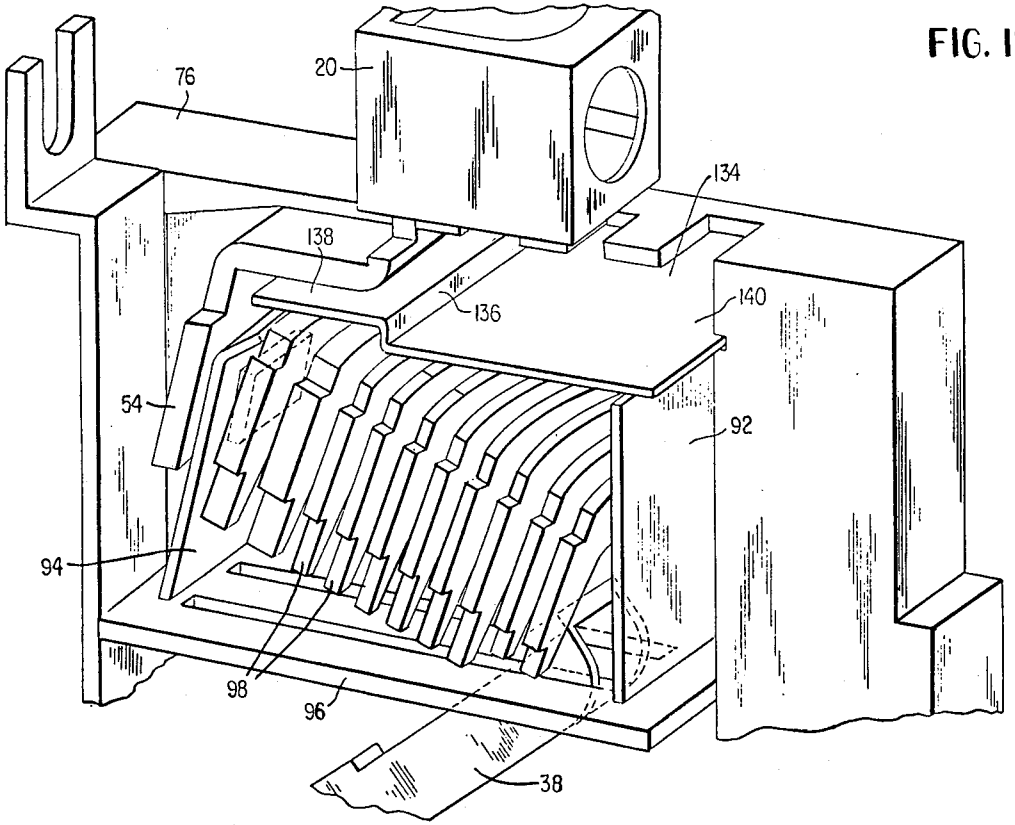
FIG. 12 shows a modified embodiment for use in explosive (marine) atmosphere.

FIG. 12 shows a modified embodiment of the present invention in which like parts bear like reference numerals. The embodiment in FIG. 12 is identical to the one previously described with the exception that the terminal insulator 56 of FIG. 6 and the screen 70 are replaced by an integral "marine" shield 134. The shield 134 which is again preferably made of fishpaper is bent as at 136 to define a first portion 138 corresponding to the insulating baffle 56 of FIG. 6 and a second portion 140 which directly replaces screen 70. The embodiment of FIG. 12 is particularly adapted for use in potentially explosive atmospheres as in a boat where gasoline vapors tend to collect in the boat bilge. The provision of shield 134 ensures that the explosive gasoline vapors will not be ignited by the arcing accompanying the opening and closure of the circuit breaker contacts. Incorporation of the marine shield 134 in place of the plasma dispersing screen of course reduces the performance of the circuit breaker and does not permit the high voltage and current ratings as in the embodiment previously described. However, FIG. 12 does illustrate how the high rating circuit breaker of the present invention may be simply and readily adapted to use in explosive atmospheres where high voltage and current ratings are not required.

It is apparent from the above that the present invention provides an improved circuit breaker construction and, in particular, one which provides improved performance, permitting higher current ratings in a specific size breaker housing. Important features of the invention include incorporating in the arc vent of the circuit breaker a stainless steel or other corrosion-resistant unplated metal screen having an optimum size and mesh size so that the desired cooling and dispersion of the gas plasma is obtained without at the same time burning out the mesh. In addition to cooling the plasma by conducting heat away and breaking it up or dispersing it, it is believed that the screen provides some significant amount of filtering action, since it has been noted that the screen after substantial usage appears to collect silver and perhaps some other portions of solidified metal from the circuit breaker contacts. That is, the circuit breaker contacts are conventionally formed from about a 50/50 ratio of silver and tungsten and the collection of metal on the screen is believed to be primarily deposited silver which has vaporized from the circuit breaker contacts. The screen prevents substantial portions of this material from exiting the breaker and depositing upon adjacent surfaces where it can eventually cause a short circuit.

Important features of the invention also include a novel enclosed arc chamber assembly with substantial amounts of heavy metal in the area of the circuit breaker contacts. Heat is rapidly conducted away by the metal and the enclosed nature of the chamber helps to prevent heat from the arc gases decomposing or otherwise damaging the plastic material of the molded plastic circuit breaker case. Also shown is how a slight modification of the basic construction permits use of the device as a marine breaker.

The invention may be embodied in other specific forms without departing from the spirit or essential characteristics thereof. The present embodiment is, therefore, to be considered in all respects as illustrative and not restrictive, the scope of the invention being indicated by the appended claims rather than by the foregoing description, and all changes which come within the meaning and range of equivalency of the claims are, therefore, intended to be embraced therein.

What is claimed and desired to be secured by United States Letters Patent is:

1. A circuit breaker comprising a housing, stationary and movable contacts in said housing, a handle, a collapsible toggle coupling said handle to said movable contact, overcurrent means coupled to said toggle for tripping said toggle, an arc chamber in said housing substantially surrounding said contacts, said arc chamber comprising heat insulating baffles on five sides of said chamber and a metal shoe on a remaining side of said chamber, one of said five sides of said chamber comprising both a baffle and a wire mesh screen, said housing having an arc gas vent adjacent said contacts for venting arc gases from the area of said contacts to atmosphere, said wire mesh screen being made of temperature and corrosion-resistant material and overlying said vent, said screen having a wire diameter size of from 0.028 to 0.032 inch, with the center-to-center spacing of said wires being from 1/14th to 1/18th of an inch.

2. A circuit breaker according to claim 1 wherein said screen is made of stainless steel.

3. A circuit breaker according to claim 2 wherein said screen is made of 0.032 inch diameter wire on 1/16th inch centers.

4. A circuit breaker according to claim 2 wherein said screen is made of 0.032 inch diameter wire on 1/14th inch centers.

5. A circuit breaker according to claim 2 wherein said screen is made of 0.032 inch diameter wire on 1/18th inch centers.

6. A circuit breaker according to claim 2 wherein said screen is made of 0.028 inch diameter wire on 1/18th inch centers.

7. A circuit breaker according to claim 2 wherein said screen is made of stainless steel selected from the group consisting of type 302, type 304, type 305, type 410 and type 430.

8. A circuit breaker according to claim 7 wherein said screen is made of type 302 stainless steel.

9. A circuit breaker comprising a housing formed of two mating sections, a pair of relatively movable contacts in said housing, a handle, a collapsible toggle coupling said handle to one of said contacts, overcurrent means coupled to said toggle for tripping said toggle, an arc chamber in said housing substantially surrounding said contacts, said arc chamber comprising heat insulating baffles on five sides of said chamber and a metal shoe on a remaining side of said chamber, one of said five sides of said chamber comprising both a baffle and a wire mesh screen of temperature and corrosion-resistant material, a plurality of spaced projections on one of said housing sections extending toward the other section, a plurality of cooperating spaced projections on said other section extending toward said one section, said projections on said other section being in alignment with but outwardly spaced from the projections on said one section whereby arc gases may escape from said housing, not only by passing between adjacent projections on a housing section, but also between the aligned projections of the respective housing sections, said wire mesh screen being located between said contacts and said projections, said screen having a wire diameter size of from 0.028 to 0.032 inch, with the center-to-center spacing of said wire being from 1/14th to 1/18th of an inch.

10. A circuit breaker according to claim 9, including a flange on the breaker section having the innermost of said projections whereby arc gases venting between aligned projections are deflected by said flange.

11. A circuit breaker according to claim 10, wherein said projections on said first and second sections overlap.

12. A circuit breaker according to claim 9, wherein said screen is made of stainless steel containing between 12and 30 percent by weight of chromium.

13. A circuit breaker according to claim 12, wherein said stainless steel contains from 8 to 13 percent by weight of nickel.

14. A circuit breaker according to claim 12, wherein said stainless steel contains from 11.5 to 20 percent by weight of chromium.

15. A circuit breaker according to claim 14, wherein said stainless steel contains 17 to 19 percent by weight of chromium.

16. A circuit breaker according to claim 15, wherein said stainless steel contains 8 to 10 percent by weight of nickel.

17. A circuit breaker according to claim 1 including an arc gas exhaust chute in said housing, said wire screen permitting fluid communication between the interior of said arc chamber and said exhaust chute.

18. A circuit breaker according to claim 1 including an arc gas exhaust chute in said housing, one of said five baffles at least substantially closing off said arc chamber to the exhaust of gases through said exhaust chute.

19. A circuit breaker according to claim 1 wherein a plurality of metallic arc suppressors are supported by a pair of said five baffles adjacent the path of said moveable contact.

20. A circuit breaker according to claim 19 wherein said arc suppressors are arranged in groups of different length.

21. A circuit breaker according to claim 19 wherein said arc suppressors are of different thickness.

22. A circuit breaker according to claim 21 wherein the arc suppressors adjacent said stationary contact are of greater thickness than those more remote from said stationary contact.

23. A circuit breaker according to claim 1 wherein one of said baffles is slotted to receive a bifurcated contact bar carrying said movable contact.

24. A circuit breaker according to claim 1 wherein said baffles are made of electrical and heat insulating material.

25. A circuit breaker according to claim 24 wherein said baffles are made of vulcanized fiber.

* * * * *

UNITED STATES PATENT AND TRADEMARK OFFICE

CERTIFICATE OF CORRECTION

PATENT NO. : 3,997,746

DATED : December 14, 1976

INVENTOR(S) : George S. Harper; Lyal N. Merriken

It is certified that error appears in the above-identified patent and that said Letters Patent are hereby corrected as shown below:

Column 4, line 50, "channel 62" should read --chute 88--.

Column 5, line 20, "stell" should read --steel--.

Signed and Sealed this

Fifteenth Day of March 1977

[SEAL]

*Attest:*

RUTH C. MASON
*Attesting Officer*

C. MARSHALL DANN
*Commissioner of Patents and Trademarks*